US006136053A

United States Patent [19]

Sullivan

[11] Patent Number: 6,136,053

[45] Date of Patent: Oct. 24, 2000

[54] METHOD AND APPARATUS FOR STARTING FIRES

[76] Inventor: Colin Sullivan, 1022 Dunton St., Ketchikan, Ak. 99901

[21] Appl. No.: 09/334,242

[22] Filed: Jun. 16, 1999

[51] Int. Cl.[7] ..... C10L 11/04

[52] U.S. Cl. ..... 44/506; 44/507; 44/508; 44/531; 44/544

[58] Field of Search ..... 44/506, 507, 508, 44/531, 544

[56] References Cited

U.S. PATENT DOCUMENTS

| | | | |
|---|---|---|---|
| 436,509 | 9/1890 | Walters . | |
| 443,986 | 12/1890 | Fredrikson . | |
| 612,293 | 10/1898 | Wolf . | |
| 618,997 | 2/1899 | Rose . | |
| 1,275,543 | 8/1918 | Fear et al. . | |
| 2,094,661 | 10/1937 | Macleay et al. . | |
| 2,811,428 | 10/1957 | Smith . | |
| 4,060,396 | 11/1977 | Burton | 44/14 |
| 4,189,305 | 2/1980 | Clayton | 44/41 |
| 4,485,584 | 12/1984 | Raulerson et al. | 44/66 |
| 4,564,370 | 1/1986 | Gregory | 44/38 |
| 4,623,324 | 11/1986 | Zulkowitz | 493/462 |
| 5,496,605 | 3/1996 | Augst et al. . | |
| 5,830,245 | 11/1998 | Raddon . | |

*Primary Examiner*—Jerry D. Johnson

*Attorney, Agent, or Firm*—Walter J. Tencza, Jr.

[57] ABSTRACT

The present invention provides an ignitable fire starting system, including the fuel and the means to ignite. A method is disclosed comprised of the steps of soaking a strip of cloth in a liquid fuel and laying one or more sources of ignition on the fuel soaked strip of cloth. The one or more sources of ignition can be one or more matches. The strip of cloth can be divided into a plurality of sections. The fuel soaked strip of cloth and the one or more sources of ignition may be rolled up to form a cylinder. When one wants to start a fire, one may unroll the cylinder and detach a first section of the fuel soaked strip of cloth. The liquid fuel may be a wax such as paraffin. The step of dividing the strip of cloth into a plurality of sections may comprise partially cutting the cloth along first and second lines where the first line and a first end of the cloth are the boundaries for a first section of the cloth and the second line and the first line are the boundaries for a second section of the cloth. If a wax such as paraffin is used, it may be hot, such as above its melting point when the strip of cloth is soaked in it, when the one or more sources of ignition are laid on top of the soaked strip of cloth, and when the soaked strip cloth is rolled up to form a cylinder. The liquid fuel can thereafter be allowed to cool down and harden and then one of the one or more sources of ignition can be ignited to cause the particular source of ignition to ignite. After the liquid fuel is allowed to cool down and harden but before one of the one or more sources of ignition is ignited, excess fuel can be removed from the source of ignition that will be ignited.

2 Claims, 1 Drawing Sheet

METHOD AND APPARATUS FOR STARTING FIRES

FIELD OF THE INVENTION

This invention relates to improved methods and apparatus for starting fires.

BACKGROUND OF THE INVENTION

Man has been fascinated with fire since the beginning of time and has harnessed the power of fire for a great many uses. Even in our modern technological society man continues to utilize and enjoy fire in a wide variety of areas, such as outdoor cooking, campfires for enjoyment, wood stoves for heat, and fireplaces for warmth and beauty. While most of the previous are recreational in nature, starting a suitable fire can often be a frustrating experience, and for this reason a suitable fire starter is needed. With the growing popularity of canoeing, camping, back-country backpacking, and a variety of other outdoor activities, not only is there a need for a suitable fire starter, but also for one that is compact, light-weight, self-contained, and waterproof.

Given the requisite skill and sufficient time, anybody can satisfactorily build and start a fire. But in many instances, people today do not have the time, patience or proficiency to adequately gather the materials for starting a fire.

One method is to use old newspapers crumpled into balls, placed beneath the material to be burned, and ignited, but paper has a tendency to burn too fast, be blown out of position by high winds, and will not ignite after being wetted. Another method is to use shavings of wood, or very small pieces of kindling to start a small fire and gradually build up to a fire of suitable size. Making the shavings and gathering the kindling takes time and again they will not burn if wetted, such as by rain or snow. Both of these methods also require that a person has an independent source of ignition such as matches, flint and steel, or a cigarette lighter.

Another approach is to use flammable liquid fuels, such as kerosene, gasoline, or diesel. Pouring one of these products on the material to be burned and allowing it to permeate the material allows for rapid and intense ignition of the material when struck with an independent source of flame or sufficient heat. While popular for starting bonfires, these petroleum products have some serious drawbacks. First and foremost is an issue of safety. These products are volatile and extremely flammable, and present an explosion and fire hazard during storage and use. Additionally, because of this volatility, there is a rapid rate of evaporation and loss during use and before lighting.

Through the years various other methods have been devised in order to start fires more easily. U.S. Pat. No. 4,189,305 (Clayton, 1980), incorporated by reference herein, discloses a paraffin soaked cellulistic material which is useful for this purpose. U.S. Pat. No. 4,623,324 (Zulkowitz, 1986) incorporated by reference herein discloses a method for using newspaper with similar effect. Other patented methods include U.S. Pat. No. 3,351,444 Ryan, 1967, U.S. Pat. No. 4,060,396 (Burton, 1977) and U.S. Pat. No. 4,564,370 Gregory, 1986), all incorporated by reference herein.

SUMMARY OF THE INVENTION

It is an object of the present invention to provide an ignitable fire starting system, including the fuel and the means to ignite the fire. One embodiment of the present invention discloses, a compact, lightweight, water-proof, self contained, odor-free, easily ignitable in inclement weather, stable, and safe to handle fire starting method and apparatus. An embodiment is disclosed which provides enough heat to amply start a campfire, charcoal grill, wood stove, or any other place where a fire starter is desired. In one embodiment a waterproof apparatus is disclosed which floats, which makes it ideal for emergency kits on boats and airplanes, as well as for canoeing, kayaking, fishing, hunting, and any other outdoor activity where one may encounter dampness.

The present invention in one embodiment discloses a method comprised of the steps of soaking a strip of cloth in a liquid fuel and laying one or more sources of ignition on the fuel soaked strip of cloth. The one or more sources of ignition can be one or more matches. The strip of cloth can be divided into a plurality of sections. The fuel soaked strip of cloth and the one or more sources of ignition may be rolled up to form a cylinder. When one wants to start a fire, one may unroll the cylinder and detach a first section of the fuel soaked strip of cloth. The liquid fuel may be a wax such as paraffin.

The step of dividing the strip of cloth into a plurality of sections may comprise partially cutting the cloth along first and second lines wherein the first line and a first end of the cloth are the boundaries for a first section of the cloth and the second line and the first line are the boundaries for a second section of the cloth.

If a wax such as paraffin is used for the fuel, it may be hot, such as above its melting point, when the strip of cloth is soaked in it, when the one or more sources of ignition are laid on top of the soaked strip of cloth, and when the soaked strip cloth is rolled up to form a cylinder. The liquid fuel can thereafter be allowed to cool down and harden and then one of the one or more sources of ignition can be ignited to cause the particular source of ignition to ignite. After the liquid fuel is allowed to cool down and harden but before one of the one or more sources of ignition is ignited, excess fuel can be removed from a source of ignition that will be ignited. For example wax (liquid fuel) can be removed from a match (source of ignition).

The temperature of the paraffin when the strip of cloth is soaked in it depends on the melting point of the paraffin or similar wax. The various waxes vary in melting point from 117 degrees Fahrenheit on the low end to 145 degrees Fahrenheit on the high end. One paraffin that can be used has a melting point of 129 degrees Fahrenheit. It is important to raise the temperature of the wax far enough past its melting point to ensure that the wax is totally liquefied.

DETAILED DESCRIPTION OF THE DRAWINGS

Figure 3:
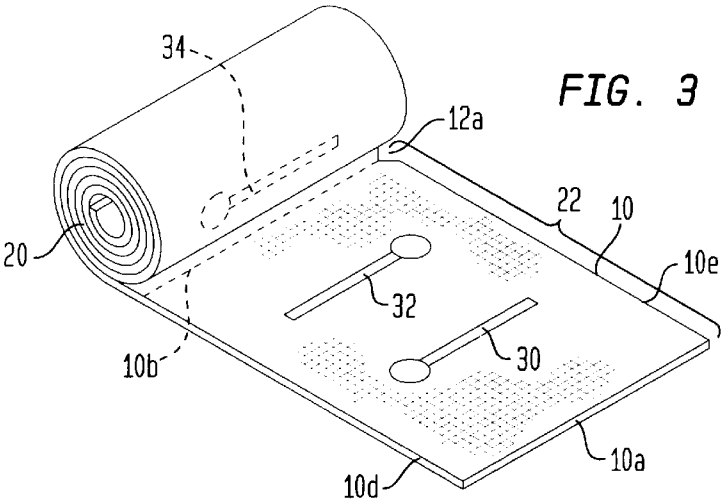
FIG. 3 shows the strip of cloth and matches of FIG. 2 rolled into a cylinder.
Figure 1:
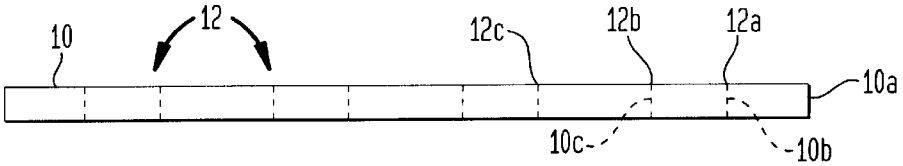
FIG. 1 shows a strip of cloth with cuts.

FIG. 1 shows a strip of cloth 10 with cuts 12 which include cuts 12*b* and 12*a*. The strip of cloth 10 has an end 10*a*. The cuts 12 are used to facilitate tearing of the cloth 10. For example, the cuts 12*a* and 12*b* are partial cuts made along the lines 10*b* and 10*c*, respectively, as shown in FIGS. 1 and 3. The cloth 10 can be any natural fiber material woven or of knit manufacture. Preferably, 100% cotton terry cloth of woven manufacture will be used, but any similar material, such as hemp, manila, linen, or other plant based cloth material can also be used.

Figure 2:
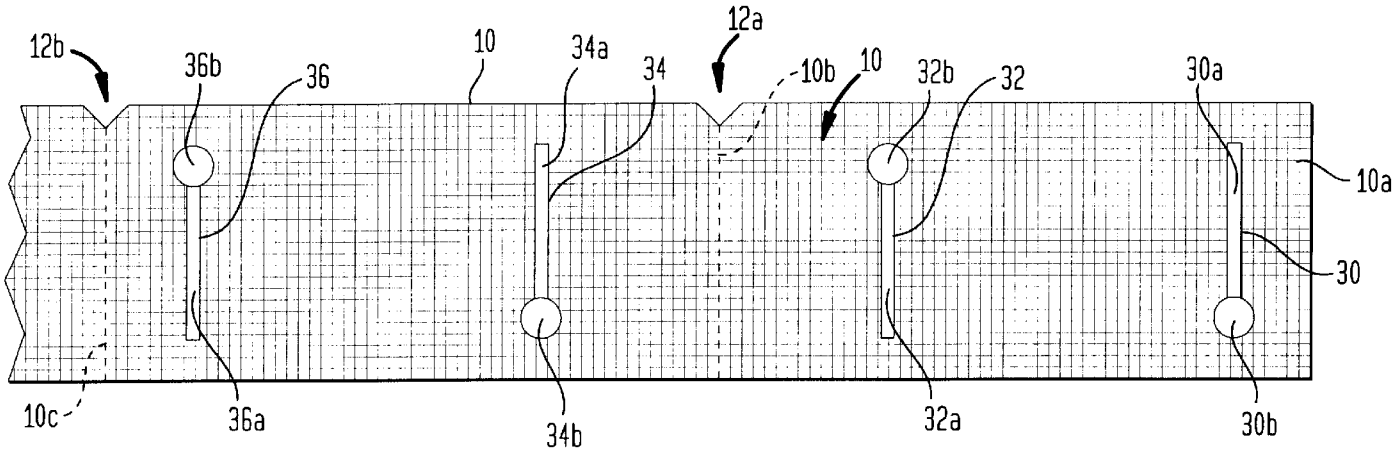
FIG. 2 shows the strip of cloth of FIG. 1 with matches laid on top of it.

FIG. 2 shows the strip of cloth 10 of FIG. 1 with matches 30, 32, 34, and 36 laid on top of it. The matches 30, 32, 34, and 36 have match sticks 30*a*, 32*a*, 34*a*, and 36*a* and match heads 30*b*, 32*b*, 34*b*, and 36*b* respectively. The FIG. 2 drawing shows the cuts 12*a* and 12*b* in the cloth 10 along lines 10*b* and 10*c*.

FIG. 3 shows the strip of cloth 10 rolled into a cylinder 20 with part 22 of the cloth 10 not rolled into the cylinder 20. The rolled part of the cloth 10 can include a plurality of attached matches, the location of one of which is shown by dashed lines 16. The part or section 22 can be torn off by holding the cylinder 20 with one hand and pulling the end 10*a* of the cloth 10 with the other hand. This will cause the cloth 10 to rip approximately along line 10*b* which extends from the partial cut 12*a*. In this manner the section 22 of cloth 10 can be detached from the rest of the cloth 10. The section 22 detached would include attached matches 30 and 32. The line 10*b* can be initially perforated in a manufacturing process.

This invention in some embodiments is useful as a portable, self-contained device for facilitating the kindling of fires, such as wood, charcoal, or other combustible materials. More particularly, it is useful as a relatively safe, nearly smokeless, self-contained product for igniting campfire, wood stoves, fireplace logs, or charcoal briquettes.

The strip of cloth 10 may be a long, narrow, rectangular strip of natural fiber cloth, such as 100% cotton terry cloth, which has cuts at desired intervals to facilitate tearing of the material.

The cloth strip 10 may be soaked in a paraffin bath. Semi-refined paraffin is a suitable fuel, although any similar petroleum or natural based product will work. The cloth strip 10 can be removed from the bath, and any number, two being the ideal, of "strike anywhere" matches, such as matches 30 and 32 are laid on each section such as section 22 shown in FIG. 3. Matches 30 and 32 are laid between lines 10*a* and 10*b*. Matches 34 and 36 can be laid between lines 10*b* and 10*c*. While the wax is still warm, it should be above its melting point the cloth strip 10 with the matches 30, 32, 34, and 36 and other matches not shown is rolled into a cylinder 20 and allowed to dry. Sources of ignition other than matches 30, 32, 34, and 36 can also be used. While a variety of sizes are possible, a strip 3 inches wide by 50 inches long with cuts 12 every 5 inches will produce a cylinder 20 approximately 3" in length by 2" in diameter. When the wax has fully cooled and hardened, the final product is smooth to the touch, light-weight, very durable, and completely water-proof. A variety of hues can be added to the wax to produce different colored product, such as international orange for emergency kits.

For purposes of the following discussion assume that section 22 has also been rolled into and is a part of cylinder 20 of FIG. 3. To use the invention, one simply peels off a "section" such as section 22, until a cut, such as cut 12*a*, is reached. By simply pulling down on the material of cloth 10 at the cut 12*a* or at end 10*a* of the cloth 10, section 22 will tear off the cylinder 20. The section 22 has two "strike anywhere" matches 30 and 32 attached to it. Match 30 has its match head 30*b* closer to the edge 10*d* rather than the edge 10*e* of the cloth 10. Match 32 has its match head 30*b* closer to the edge 10*e* rather than the edge 10*d* of the cloth. This "opposing" configuration is desirable so that the section 22 is more easily ignited by rubbing the section 22 against a coarse surface. By removing excess wax from the match heads 30*b* and 32*b* with a thumbnail then striking the match 30 or 32 on any rough surface, you have the means to ignite the section 22. The nature of the cloth 10, which acts like a wick, allows for rapid ignition when the match, such as match 30 or 32, is touched to the material of the cloth 10 and produces a suitable flame for starting a fire which does not give off dangerous fumes, odors, and is relatively smoke free.

The present invention in some embodiments, when used in accordance to the teachings of this disclosure, is non-volatile and non-explosive, and is therefore safe to store, ship, and handle. Furthermore, the disclosed invention in some embodiments does not require external packaging as the unit is self-contained and impervious to weather.

The weight of the cloth material for cloth 10 as measured by industry standards can vary widely depending on the material and the weave or knit. Weights vary from 7.5 ounces per square yard to 14 ounces per square yard. The preferable weight is around 9 ounces, although the other weights of the cloth material or cloth 10 will work as well and depend on the specific fiber being used to manufacture the cloth 10. Neither the weight nor the natural fiber used, nor the actual dimensions of the material used is of utmost concern, so long as the material is sufficiently absorbent to hold the paraffin in sufficient quantity until the paraffin hardens.

A 3 inch width for each section such as section 22 allows the matches, such as matches 30 and 32 to be completely protected by the paraffin soaked material. Each section, such as section 22 is sufficient to start a fire, although the dimensions of the section 22, or the distance between cuts 12*a* and 12*b* (or 12*b* and 12*c* etc.) can be varied to meet specific requirements. It has been found that one 3 inch by 5 inch section 22 produces a large flame which lasts from 6 to 8 minutes in duration. The distance between cuts 12 can be uniform (i.e. the distance between 12*a* and 12*b* is the same as the distance between 12*b* and 12*c*.)

As indicated, the cloth material 10 can be soaked in a semi-refined paraffin wax, such as ROBWAX 1520 (trademarked), or a similar product. Fully refined paraffin, beeswax, or other similar products may be used. A particular paraffin (whose melting point is 129 degreees) can be placed in a double boiler and heated to approximately 150 degrees Fahrenheit to achieve a liquid state. The temperature for the heating stage will vary depending on the melting point of the wax used. The cloth material 10 can then be run through the melted wax and onto a screened table where the excess is allowed to drop off. The impregnation of the wax into the cloth 10 takes just a matter of seconds. Other methods, such as spraying, rolling, or pressing the melted wax into the material may also be employed, as long as the paraffin saturates the cloth 10.

While the paraffin is still warm, which can be above its melting point, and thus pliable, strike anywhere matches 30, 32, 34, and 36 and other matches not shown, such as those manufactured by DIAMOND BRANDS (trademarked), are laid between the cuts 12, with the heads of the matches 30*b*, 32*b*, 34*b*, 36*b*, etc. alternating 180 degrees to facilitate a smooth cylinder 20. Laying the match heads all in the same direction yields a cone, which will not properly protect the matches. Safety matches may also be used with the addition of abrasive surface suitable for striking the match head to achieve ignition. This surface may be comprised of a narrow strip of continuous material, which can be placed on each strip 10 during the manufacturing process or the abrasive surface may be comprised of individual patches of suitable material placed at intervals between each cut, such as cut 12*a*, 12*b*, and 12*c* during the during the manufacturing process.

Once the matches are in place, the strip of cloth 10 is rolled into a cylinder 20 and allowed to dry, yielding a hard, smooth, odor-free, self-contained fire starting apparatus.

I claim:

1. A method comprising the steps of:

soaking a strip of cloth in a fuel which is in a melted state;

laying one or more sources of ignition on the fuel soaked strip of cloth while the fuel is in a melted state;

allowing the fuel to harden so that the one or more sources of ignition become attached to the strip of cloth;

wherein the fuel is wax;

further comprising providing a plurality of matches for the one or more sources of ignition including a first match and a second match;

wherein the first match has a first match head and the second match has a second match head;

wherein the strip of cloth has a top edge and a bottom edge;

wherein the first match head is situated so that it is closer to the top edge than the bottom edge; and the second match head is situated in an opposite manner from the first match head so that the second match head is closer to the bottom edge of the strip of cloth than to the top edge.

2. An apparatus comprised of:

a strip of cloth; and a plurality of matches each of which is attached to the strip of cloth by a hardened fuel;

wherein the strip of cloth has been divided into sections by perforated lines;

wherein the plurality of matches is comprised of a first match having a first match head and a second match having a second match head;

the strip of cloth is comprised of a first edge and a second edge which is opposite the first edge;

wherein the first match is situated so that the first match head is closer to the first edge than the second edge of the strip of cloth; and and wherein the second match is situated opposite to the first match, so that the second match head is closer to the second edge than the first edge of the strip of cloth.

* * * * *